US005564292A

United States Patent [19]

Geiger

[11] Patent Number: 5,564,292

[45] Date of Patent: Oct. 15, 1996

[54] WASHING MACHINE

[75] Inventor: Friedrich Geiger, Todtenweis, Germany

[73] Assignee: Bowe-Passat Reinigungs-Und Waschereitechnik GmbH, Agsburg, Germany

[21] Appl. No.: 313,158

[22] PCT Filed: Nov. 8, 1993

[86] PCT No.: PCT/JP93/03116

§ 371 Date: Oct. 6, 1995

§ 102(e) Date: Oct. 6, 1995

[87] PCT Pub. No.: WO94/11561

PCT Pub. Date: May 26, 1994

[30] Foreign Application Priority Data

Nov. 13, 1992 [DE] Germany ..... 42 38 358.7

[51] Int. Cl.[6] ..... D06F 31/00; D06F 37/22

[52] U.S. Cl. ..... 68/27; 68/140

[58] Field of Search ..... 68/27, 140, 143, 68/145; 134/66, 120; 34/129, 601; 366/233

[56] References Cited

U.S. PATENT DOCUMENTS

| | | | |
|---|---|---|---|
| 694,565 | 3/1902 | Mason | 366/233 X |
| 2,269,700 | 1/1942 | Treshow | 366/233 X |
| 2,884,287 | 4/1959 | Sommer | 68/140 X |
| 3,995,458 | 12/1976 | Grunewald et al. | 68/143 X |
| 4,020,659 | 5/1977 | Bhavsar | 68/27 |
| 4,236,393 | 12/1980 | Katzfey | 68/27 |
| 4,522,046 | 6/1985 | Dreher | 68/27 |
| 4,856,302 | 8/1989 | Eck | 68/27 |
| 5,211,039 | 5/1993 | Pellerin | 68/27 |

FOREIGN PATENT DOCUMENTS

| | | | |
|---|---|---|---|
| 335956 | 4/1977 | Austria . | |
| 3027382 | 2/1981 | Germany . | |
| 3631867 | 3/1988 | Germany | 68/140 |
| 377771 | 7/1964 | Switzerland | 68/140 |

*Primary Examiner*—Philip R. Coe

*Attorney, Agent, or Firm*—Roylance, Abrams, Berdo & Goodman

[57] ABSTRACT

A washing machine has at least one drum arranged to rotate about a spindle and bearings to absorb the axial and radial forces occurring when the drum is rotated. At least part of the bearings has a swivel with at least one roller and a tipping system to give a tipping movement transverse to the axis about which the swivel turns, or the swivel has an additional roller. The axis of rotation of the additional roller is transverse to that of the other roller of the swivel. Additional forces caused by wobbling of the washing machine drum during its movement are safely and easily absorbed so that the useful life of the bearing system is substantially increased. Time-consuming and costly maintenance work is unnecessary.

15 Claims, 8 Drawing Sheets

18
10
28
14
48
34
94
46
42
54
56
38
32
50
40
24
52
53
44
36
48
46
34
32
38
24
10
40
42
36
18
53
55

WASHING MACHINE

FIELD OF THE INVENTION

The present invention relates to a washing machine having at least one drum arranged to rotate around a spindle axis, and bearings serving to absorb radial and axial forces generated by movement of the drum.

Background of the Invention

Similar machines (U.S. Pat. No. 4,522,046, Austria 335 956 and German Printed Publication 30 27 382, for example), have long been available and are operated in single, double or tandem load mode of operation. These known washing machines are used particularly in commercial (large) washers and in hospitals, are used for large volumes of wash, and incorporate a plurality of drums arranged to rotate sequentially in series. The machines are subdivided into separate chambers for bleaching, pre-washing, main washing and rinsing of loads of wash. A 360-degree rotation of the drum is required for the passage of loads of wash through the individual, separate chambers. Each load of wash is carried through chutes into the next sequential drum. The drums are either standing still or being swivelled back and forth. To lengthen the washing time of a load of wash within one chamber, a plurality of drums instead of only one drum, can form one chamber.

All of the drums are tightly connected with one another and can be swiveled or rotated around one common spindle (rotary) axis. Bearings are present at the ends of the washing machine, as well as between the individual chambers which are formed of the drum or drums. The bearings together absorb the axial and radial forces. Beyond that, the individual drums have flexible walls on the front, loading end facing inward in the form of diaphragm walls. The flexible walls absorb the charges which occur so that the individual drum axes do not collapse with the relevant spindles because of imprecision or inaccuracy during assembly of the machine. Despite these additional compensatory measures, during movement of the drums, the same sort of wobbling of the drums still occurs, because of the weight shift occurring within the drums during movement of the wash load. As a result of the forces generated from this movement, the traditional bearings wear down rapidly. At this point still nothing is changed, even when roller bearings of highly wear-resistant special synthetic resins are used. Such bearings are of low maintenance in and of themselves. The surfaces of the annular bearings of the drum are made of extra strong high quality alloy steel. Because of the failure of the bearing arrangements in known washing machines, a great deal of down time for the entire washing installation and costly and time-intensive maintenance projects are required. Until this time generally, commercial washing machines have not been very successful commercially.

A swivel which is rotatable around a spindle is known from Austrian Patent 335 956. The swivel ends have two rollers provided with pinions which rotate the washing drum from the pivot point of the swivel outward by means of a drive mechanism. This swivel unit for swiveling the drum incorporates no bearing or support function, but is only intended to drive only individual drum segments of the entire drum installation independently from one another.

SUMMARY OF THE INVENTION

Objects of the present invention involving providing a washing machine which avoids the aforementioned drawbacks of conventional machines, and which as long lasting bearings.

The foregoing objects are basically obtained by a washing machine, comprising at least one drum mounted for rotation about a spindle axis, and bearings supporting the drum to absorb axial and radial forces generated by movement of the drum. Each bearing includes a swivel pivotally mounted about a swivel axis and at least one first roller rotatably mounted on the swivel. Tipping means are on each bearing, for pivoting the bearing about a tipping axis transverse to the swivel axis.

The foregoing objects are also basically obtained by a washing machine, comprising at least one drum mounted for rotation about a spindle, and bearings supporting the drum to absorb axial and radial forces generated by movement of the drum. Each bearing includes a swivel pivotally mounted about a swivel axis and at least one first roller rotatably mounted on the swivel. A second roller is mounted on each swivel for rotation about a rotation axis transverse to the rotation axis of the first roller.

By forming the washing machine in this manner, the additional forces, generated by movement of the relevant drum and influenced by any wobbling of the drum, are absorbed with certainty and without any problem. The formerly traditional bearings still being used, especially bearings to absorb the radial forces, are not able to absorb the additional forces generated by the drum wobbling. Such bearings which are relieved of the additional forces have a considerably longer service life, than the known devices for bearing the washing drum.

The present invention can also be used with one-drum washing machines, except for the diaphragm drum wall or elastically flexible drum wall. Even the wobbling occurring in the rigid drum walls is better absorbed and with greater certainty by the bearings according to the present invention. When the washing machine is carrying large loads, it does not break down with the bearings of the present invention. The washing machine according to the present invention is consequently secure in operation, and time-consuming and cost-intensive maintenance work is either completely deleted or required only at time intervals of great length.

In one preferred embodiment, the tipping device has a journal engaged through the middle of the swivel. At least a portion of the journal free end has a smaller diameter than that of an associated sheathing of the swivel. With this configuration, the swivel need only be tipped when it is influenced by an outwardly directed force generated by wobbling of the drum. The other bearings, in the form of the rollers of that particular swivel, are relieved by this arrangement, which lengthens their service life. Preferably, the journal has slanting, particularly spherically configured, contact surfaces, enabling the tipping of the swivel transverse to its swivel axis.

This configuration of the present invention is also space-saving. In another preferred embodiment of the washing machine, the roller located in the middle of the swivel is brought into contact with a roll-away surface arranged at the front on the drum.

Optimum load and force absorption is obtained when at least one bearing is present between each drum.

In another especially preferred embodiment of the washing machine according to the present invention, each bearing is connected with a central frame. The frame at least partially encompasses the relevant drum and has two lengthwise struts on the two drum sides. The bearings between the individual drums can be articulated as at least a part of a rocking beam or balancer of the frame. As a result of this arrangement, a precise centering of each individual bearing relative to the central frame is guaranteed. Also, each bearing which is part of a rocking beam or balancer is controlled automatically relative to the relevant drum.

The bearings are also preferably arranged on the loading and unloading ends. With the two lengthwise struts of the central frame, the bearings can be held by elastic connecting means connected with the central frame. The central frame permits mechanical uncoupling of the metal structural parts of bearing arrangements with the central frame, promoting good absorption and stabilization properties. Also, lower noise levels during operation of the washing machine and resistance to wear of the parts moving relative to each other is provided.

In another especially preferred embodiment of the washing machine according to the present invention, toothed crowns are provided at the drum loading and unloading ends. The rollers are arranged at the ends of the swivels roll along the toothed crowns. The toothed crowns cooperate with a drive mechanism for rotation of the relevant drum. In this manner, the drive moment can be reinforced in an essentially vertical plane over the swivel, so that the flexing moment-loaded bearings, which are loaded when the drive force is introduced from outside this plane, are avoided.

Preferably, the drive mechanism has two drive axes arranged parallel to and to the side of the spindle axis of the relevant drum. The drive axes and the spindle axis extend in a horizontal plane with the drum.

Introduction of considerable force to the side also occurs because each drive mechanism has only one driving belt. Between the drive axes, each belt is in engagement with the toothed crown of the associated drum.

At least one work-locating fixture or stretching device can provide an absorption and stabilizing effect on the drive belts. The device can have a power accumulator and a bar lever holding pivotally arranged installation wheels in contact with the driving belt. The service life for the relevant driving belt is thereby increased.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE PRESENT INVENTION

Figure 1:
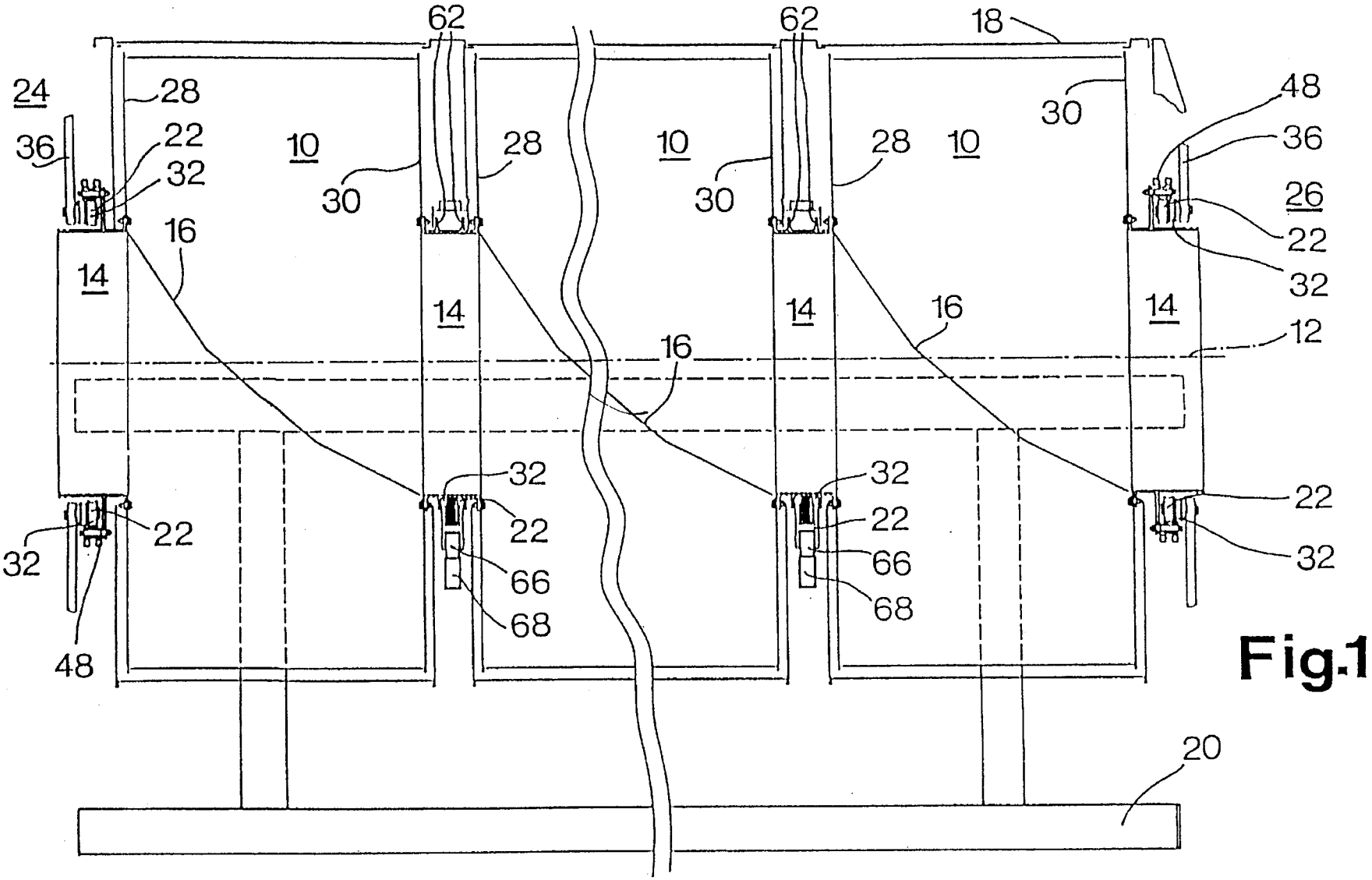
FIG. 1 is a simplified side elevational view of a washing machine according to the present invention.

The washing machine in FIG. 1 has three drums 10 arranged in sequence one behind the other. These drums can be configured to form sections of different lengths by being of different breadths. Particularly, the drums can incorporate two or more drums 10 as shown in FIG. 1 directly connected with one another into one drum. All drums 10 can be moved together around a spindle axis 12 simultaneously and in the same direction of rotation. Drums 10 are connected with one another by cylindrical connecting pieces 14 and are also open to the outside. Chutes 16 transfer the loads of wash into the next drum 10. These chutes facilitate further transport during complete rotation of drums 10. Drums 10 are surrounded by a stationary housing 18, which prevents any undesired leakage of washing detergent and/or water into the environment. For installation of the washing machine, the washing machine is mounted in a central frame 20 shown in FIG. 1 only in a basic outline.

Drums 10 of the washing machine are mounted rotatably over the connecting pieces 14 by bearings 22. Bearings 22 are arranged at loading end 24 and unloading end 26, as well as between the ends of the individual drums 10. Drums 10 furthermore can be provided on the loading end with a flexible contact wall 28 and on the unloading end with a rigid contact wall 30. In another configuration, on loading end 24 the bearing 22 is configured as a fixed bearing and on unloading end 26 as a loose or detachable bearing.

Each bearing 22 has at least one swiveling swivel 32. On at least one of the swivel free ends , swivel 32 has a roller 34, which cooperates directly with the parts of the relevant drum 10 or with drum 10 during its movement. As especially shown in FIG. 2, on loading end 24 and on unloading end 26 of the washing machine, four swivels 32 are arranged in turn diametrically around spindle axis 12. Two swivels 32 are arranged in turn between the individual drums 10. At the beginning and end of the washing machine, in other words at loading end 24 and unloading end 26, swivels 32 are swivellably mounted on so-called burn parts 36. Parts 36 in a material-saving manner, form plates, which plates are then connected with central frame 20.

Figure 2:
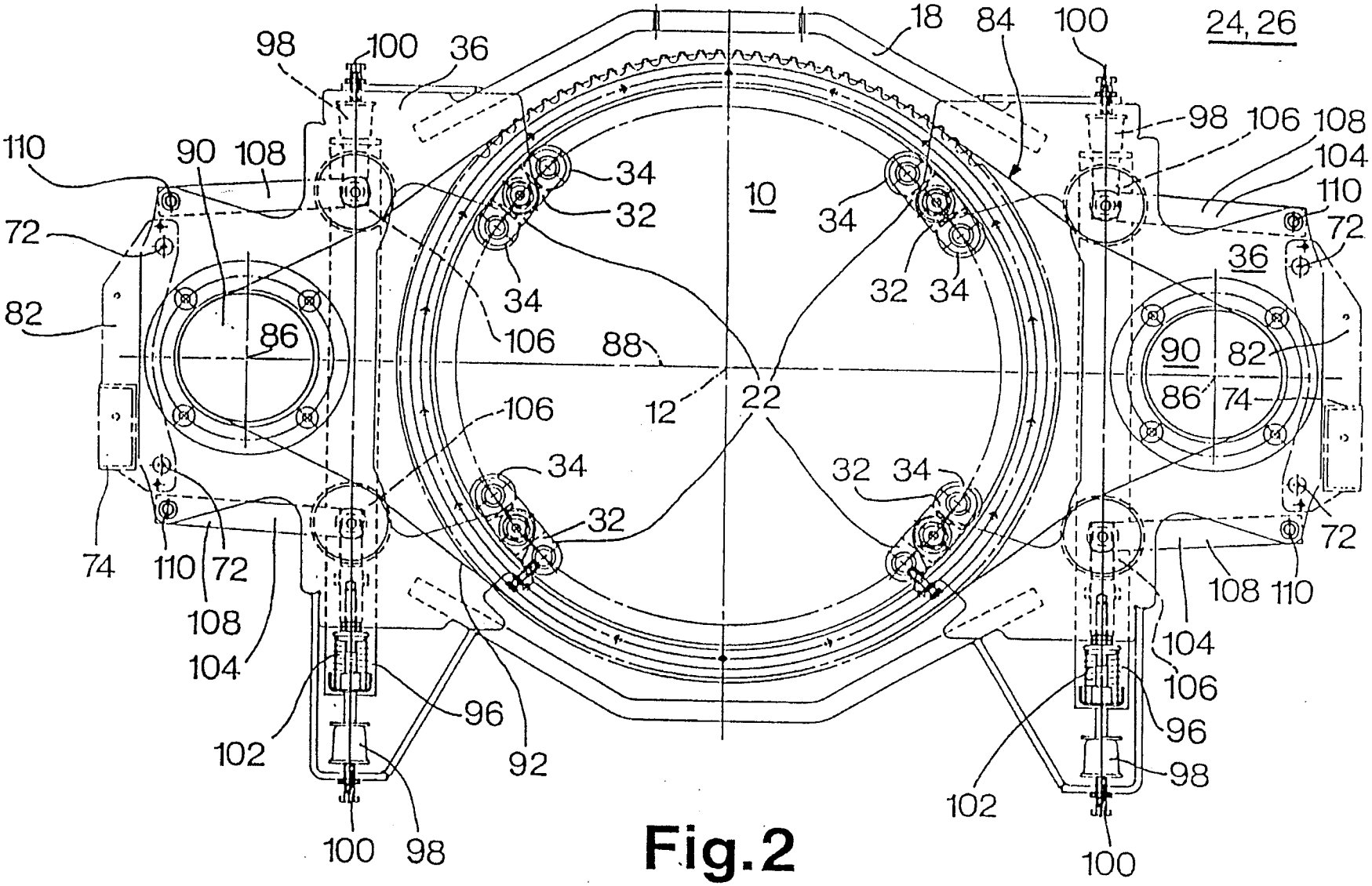
FIG. 2 is a front elevational view of the washing machine of FIG. 1, viewed from the loading end or the unloading end.

The pair of swivels 32 illustrated in the top half of FIG. 2 differs from the pair of swivels 32 illustrated in the bottom half of FIG. 2. Two rollers 34 are provided for each swivel 32. As drum 10 is pressed in rotation, one or the other roller 34 is then pressed in the same direction as the direction of rotation of drum 10, progressively more strongly on the movable parts of drum 10. Thus, rollers 34 increasingly absorb the impacting radial forces. Since the top two swivels 32 of bearing 22 seen in FIG. 2 support the main load of drum 10 associated with them, the two bottom swivels can be formed in a simpler manner. This simplified form is especially intended to replace the layouts illustrated shown in FIGS. 4*a* and 4*b*.

Figures 4A, 4B:
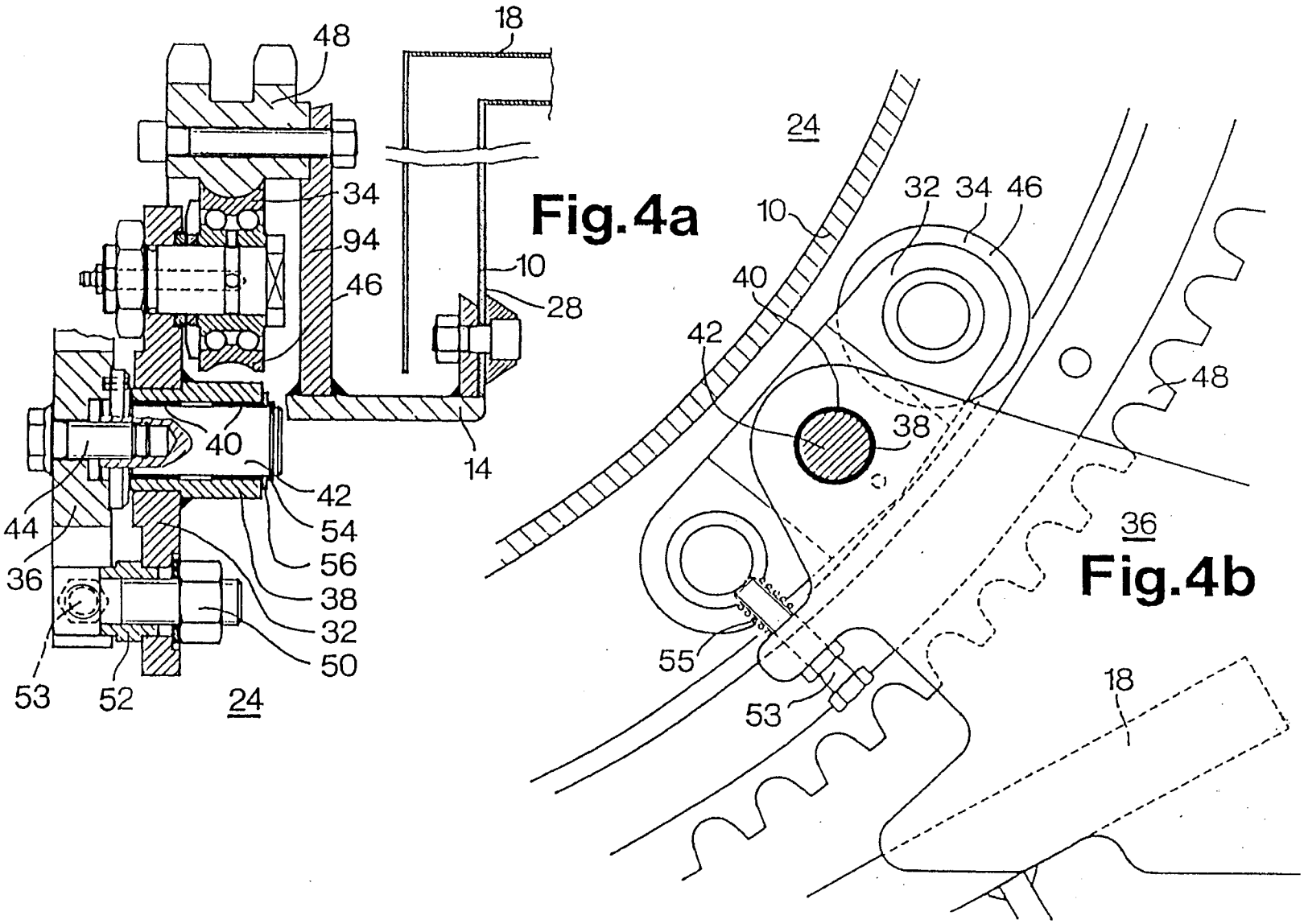
FIGS. 4*a* and 4*b* are enlarged side and front elevational views, respectively, in section, of a swivel as represented at the bottom right in FIG. 2.

As illustrated in FIGS. 4*a* and 4*b*, swivel 32 has a sheathing 38 receiving a journal 42 guided over one or more bushings 40. The journal is tightly connected through a screw connection 44 with the plate 36. Roller 34 is rotatable at the top end of swivel 32. The rotatably mounted outside ring 46 of roller 34 has a concave arch in contact with a convex ring of a toothed crown 48. The other free end of swivel 32 has an adjustment screw 50 passing through it. Adjustment screw 50, by means of a space bushing 52, allows adjustment of swivel 32 relative to plate 36. By means of the adjustment device 36, 50 and 52, the play between sheathing 38, and over one of the bushings 40 with a snap ring 54 arranged at the free end of the journal, can be preset. The play is reduced to null for implementation of the relevant fixed bearing, so that swivel 32 is not axially movable relative to stationary plate 36, but is held to be only swivellable or pivotable around journals 42. A spacing ring 56 can also be provided for production of or reinforcement of this free play between bushing 40 and snap ring 54. The spacing ring is deleted for a loose or detachable bearing, as is provided on unloading end 26 of the washing machine. The associated roller 34 of another adjustment screw 53, depending on conditions, can be set without any play against the spherical roll-away surface of toothed crown 48. With increasing wear on top roller 34, adjustment screw 52 can maintain the freedom of play automatically through spring 55 (FIG. 4*b*).

Figure 3B:
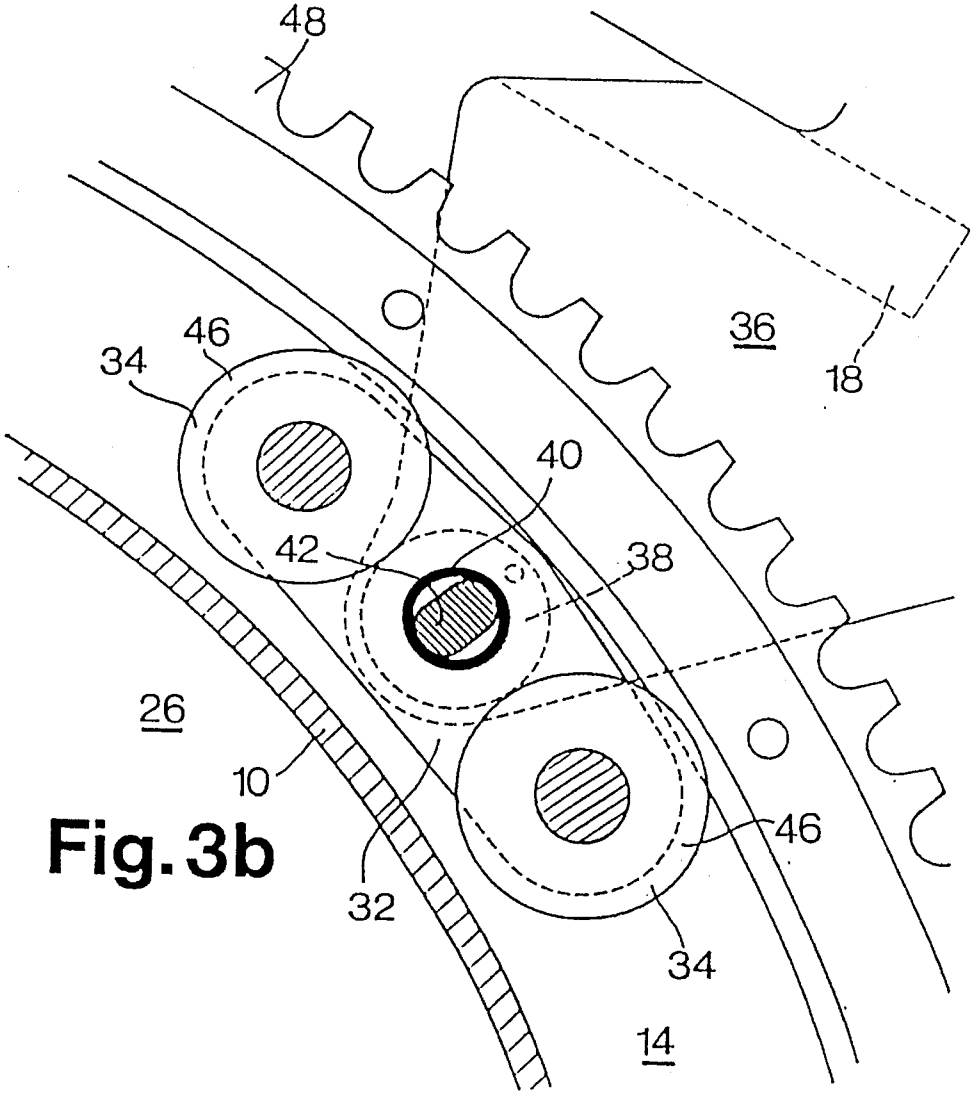
FIGS. 3*a* and 3*b* are enlarged side and front elevational views, respectively, in section, of a swivel, as represented at the top right in FIG. 2.
Figure 3A:
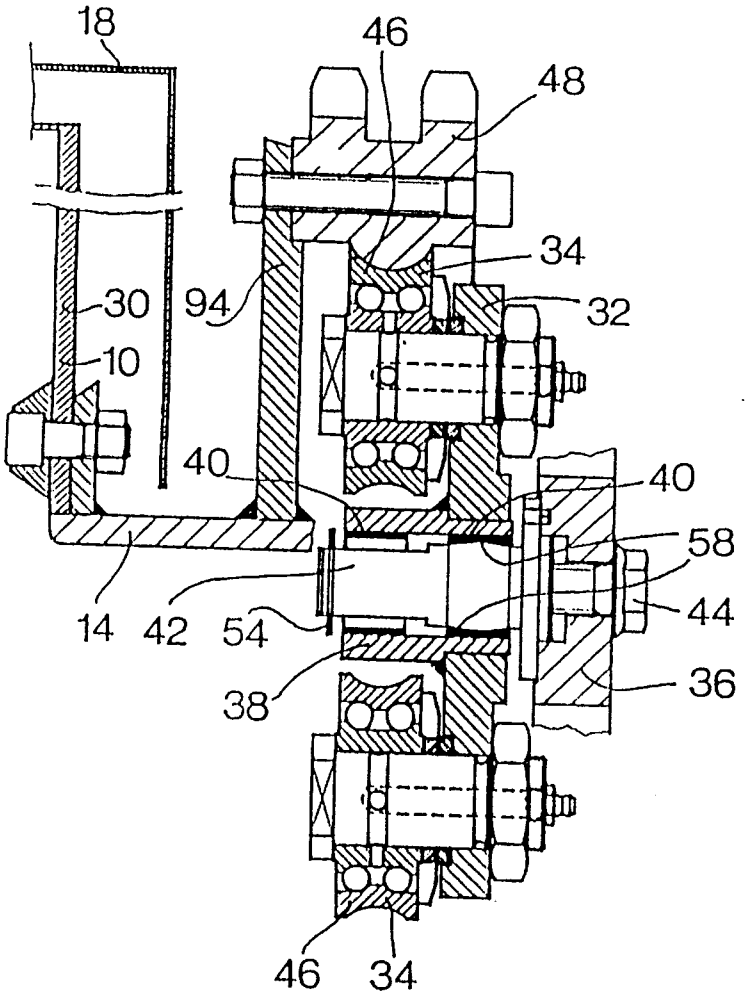

Instead of the fixed bearing on loading end 24, as shown in FIGS. 3*a* and 3*b*, top swivels 32 are mounted with journal 42 in position without any axial play with sheathing 38, just as in the embodiment described in FIGS. 4*a* and 4*b*. The representation in FIGS. 3*a* and 3*b* relates to the mounting provided for unloading end 26. Axial play is present between snap ring 54 and sheathing 38, so that axial displacement of the associated swivel 32 is guaranteed. Furthermore, the journal 42 passing through the middle of swivel 32 has a smaller diameter at its free end than the inside diameter of the associated sheathing 38. The decrease of the diameter of journal 42, as is shown particularly in FIG. 3*b*, can be undertaken in such a manner that the diametral area running transverse to the direction of movement of drum 10 is in contact with the inside diameter of sheathing 38, and not more. As a result of this, swivel 32 can be tipped, according to the illustration of FIG. 3*b*, out of the viewing plane or into the viewing plane, so that the tipping axis runs transverse to the swivel axis of swivel 32 within the viewing plane. On the end with the loose or detachable bearing, in this manner wobbling movements of the drum arrangement can be intercepted, absorbed and controlled at such loose or detachable bearing end. The referenced tipping movement of swivel 32 is still more emphasized in that journal 42 has a slanted, especially spherically configured contact surface 58.

In the case of bearings 22 located between the individual drums 10, swivels 32 have an additional roller 60 in the middle. The rotary axis of roller 60 extends perpendicular to the rotary axis of the other rollers 34 of the respective swivel 32 and can be brought into engagement with a roll-away surface 62. Surface 62 can be constructed as a rigid contact wall 30. Preferably however, roll-away surface 62, as shown particularly in FIG. 1, is formed of two annular surfaces which encircle connecting piece 14 in the middle and which can be brought into contact with the outside peripheral surface 64 of additional roller 60.

Figure 5:
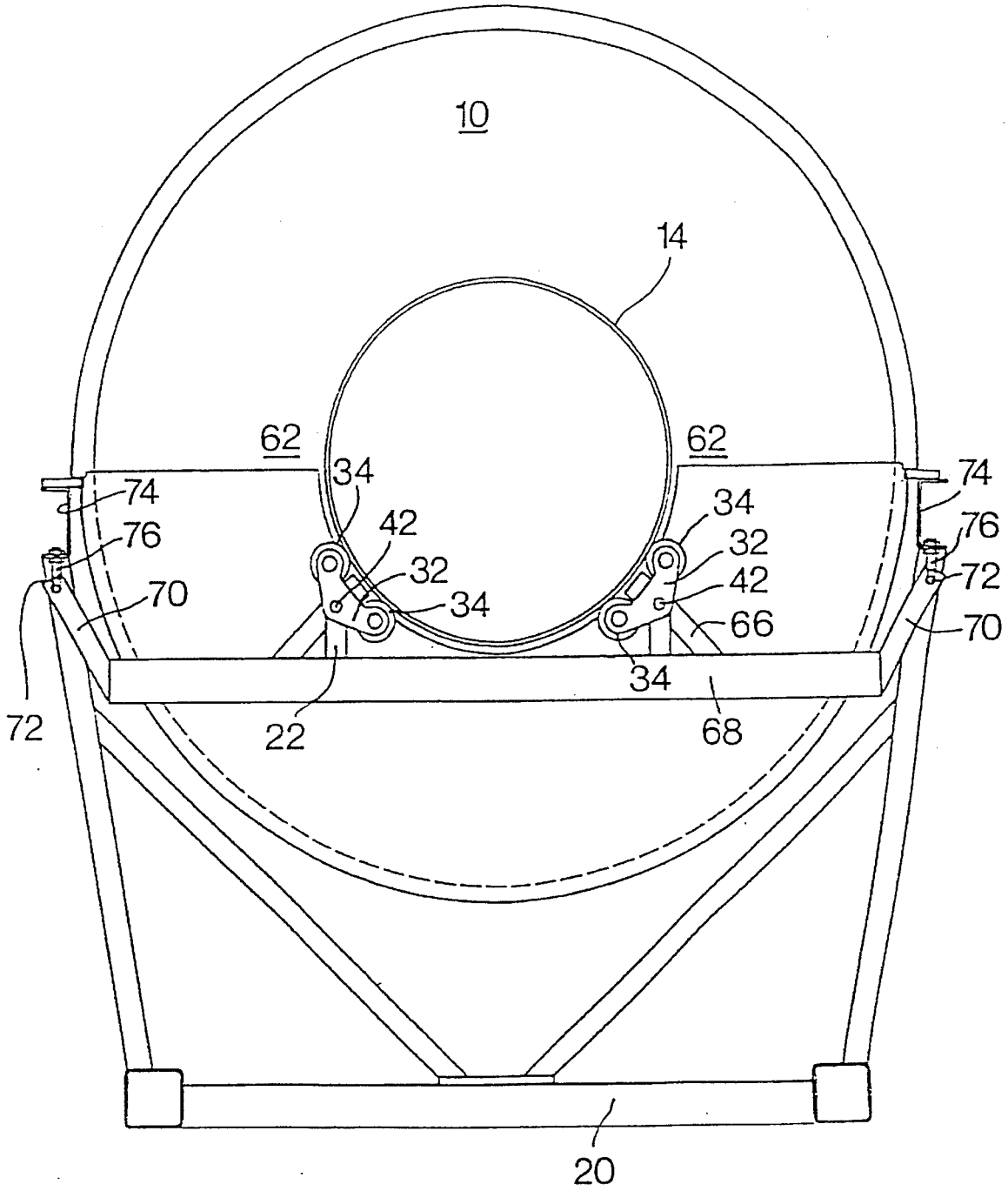
FIG. 5 is a front elevational view of a drum, as in the form of the individual drums of the washing machine.
Figure 6:
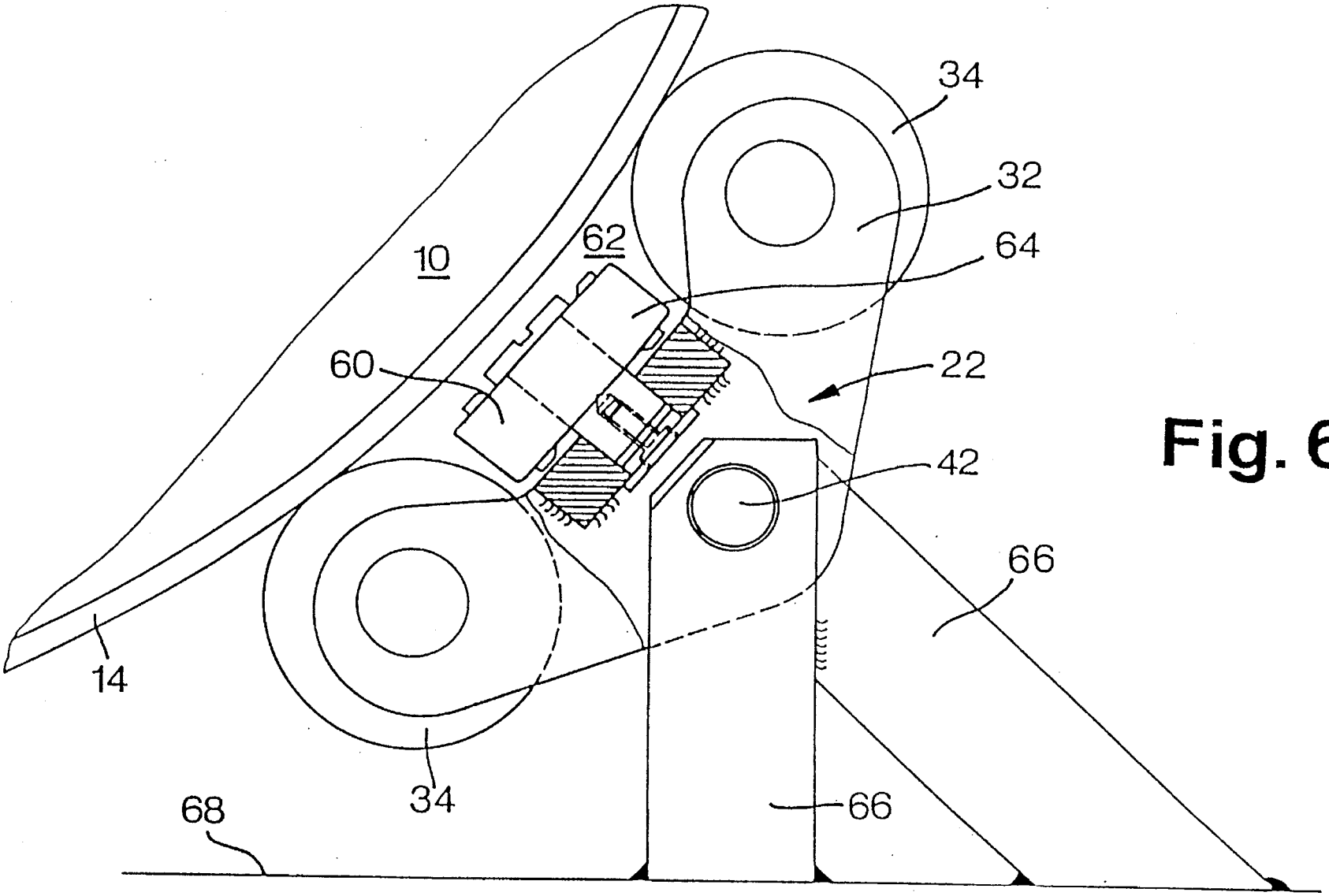
FIG. 6 is an enlarged front elevational view of a swivel as represented at the right bottom of FIG. 5.

As shown particularly in FIG. 5, two swivels 32 are arranged in the bottom half of drum 10, over connecting piece 14, which is securely connected at this point with wall 28 or 30 of drums 10. For this purpose the relevant swivel can be swivelled around cylindrical journals 42, articulated on a support 66. Support 66 is tightly connected with a transverse girder 68, which with two articulation supports 70 running obliquely upward, forms a rocking beam or balancer.

Rocking beams 66, 68, and 70 are connected through an elastic connection means in the form of rubber bushings 72 with two lengthwise struts 74 of central frame 20. As a result, a vibration-free cycle of rollers 34 and 60 is guaranteed.

Figure 7:
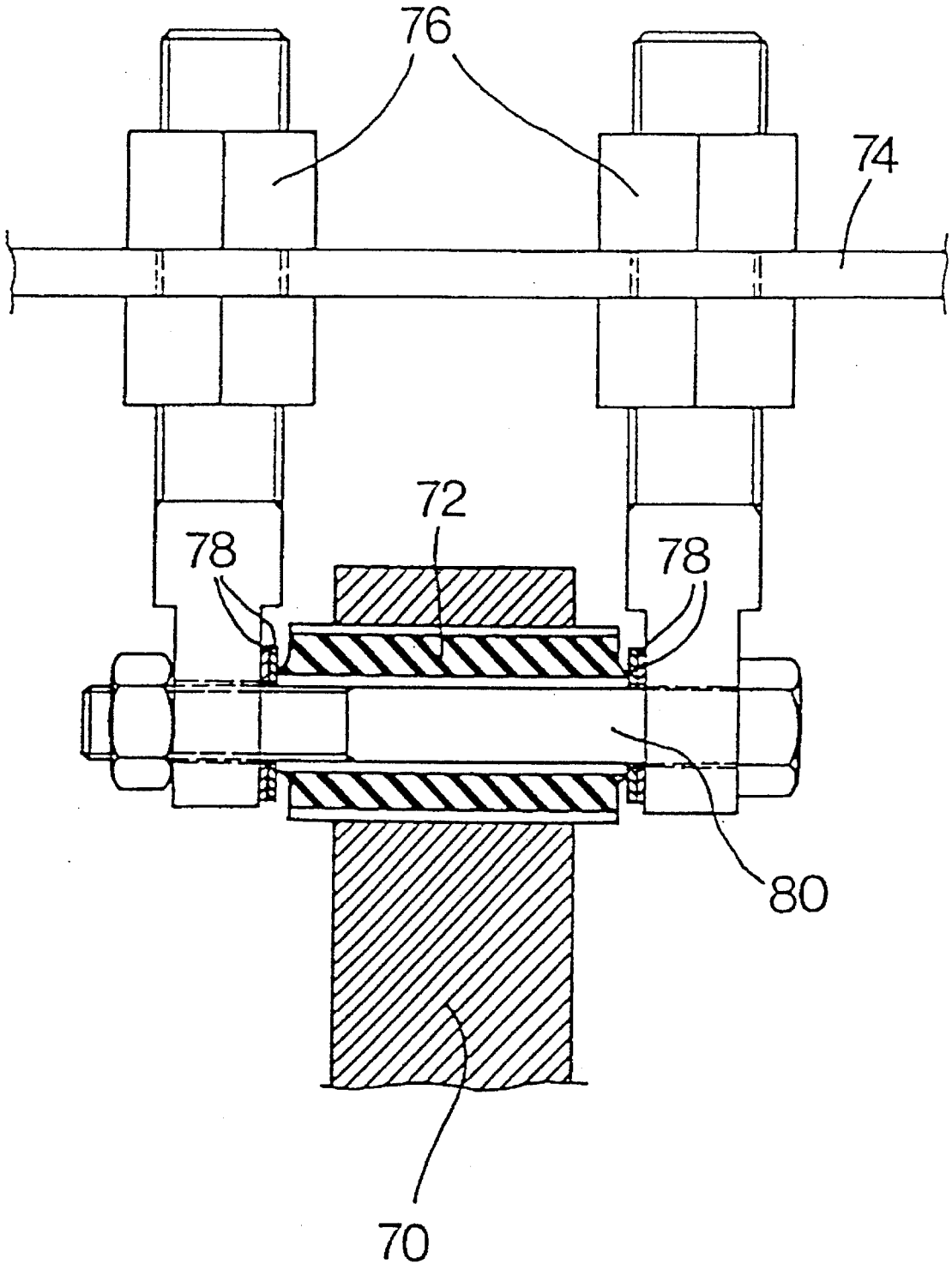
FIG. 7 is an enlarged side elevational view, in section, of an elastic bearing of the rocking beam or balancer of FIG. 5, on the central frame of the washing machine.

As shown particularly in FIG. 7, each rubber bushing 72 is surrounded by the articulation support 70 of the rocking beam, and is held by two eyebolts 76 which engage through the U-shaped lengthwise strut 74. Each rubber bushing 72 has disk springs 78 at the end, and has an adjustment screw 80 passing through it for adjustment of the rigidity of the entire system of rubber bushings 72 and disk springs 78. Adjustment screw 80 is held at the ends by extensions of the two eyebolts 76. The adjustment is gauged in the axial direction by the sheathings being maintained relatively flexible. In radial direction, the sheathings are relatively rigid in terms of their elasticity.

Bearings 22 arranged on loading end 24 and on unloading end 26 are connected through plates 36 with both lengthwise struts 74 of central frame 20. Also, bearings 22 are connected through elastic connecting means in the form of rubber bushings 72 with central frame 10. A plate element 82 is present between plates 36 and the relevant associated lengthwise strut 74. Plate segment 82 is tightly connected with lengthwise strut 74. Plates 36, elastically flexibly mounted over the rubber bushings 72 on the ends, are elastically supported with the two pairs of swivels 32.

As already indicated, rollers 34 arranged on the ends of swivels 32 roll away on loading end 24 and unloading end 26 along a toothed crown 48. For the rotation of relevant drum 10, toothed crown 48 cooperates with a drive mechanism 84. Drive mechanism 84 has two drive axes 86, arranged parallel to and to the side of spindle axis 12 of relevant drum 10 and extending in a horizontal plane 88 with such drum 10. In FIG. 2 the electric drive motors belonging to drive axes 86 are omitted from the drawing for simplicity and for improved illustration. FIG. 2 shows the driving pinions or starters 90 which are mounted rotatably around drive axes 86, within respective plates 36. Each of the two drive mechanisms 84, arranged at the ends, has a driving belt 92. Between the drive axes 86 the drive belt engages toothed crown 48 of the associated drum 10. Driving belt 92 is driven around both driving pinions 90 and engages the teeth of toothed crown 48, which is tightly connected through a partition 94 with connecting piece 14, and thus, with the associated drum 10. Toothed crown 48 has two sequentially arranged series of teeth (see FIG. 3*a*) for engagement with toothed belt 92. The drive mechanism according to the present invention, however, can also have a toothed crown with only one row of teeth.

For the drive belt or toothed belt 92 on each side of drum 10, between toothed crown 48 and the relevant driving pinion or starter 90, a work-locating or stretching device 96 is provided. Device 96 absorbs or stabilizes the drum by means of two rubber buffers 98. The degree of absorption or stabilization is adjustable by means of setting screw 100. Furthermore, each work-locating or stretching device 96, mounted in plate 36, has an accumulator in the form of an adjustable compression spring 102. Spring 102, through a bar lever 104, holds swiveling contact wheels in the form of double toothed wheels 106 in contact with driving belt 92 (see FIG. 8).

Figure 8:
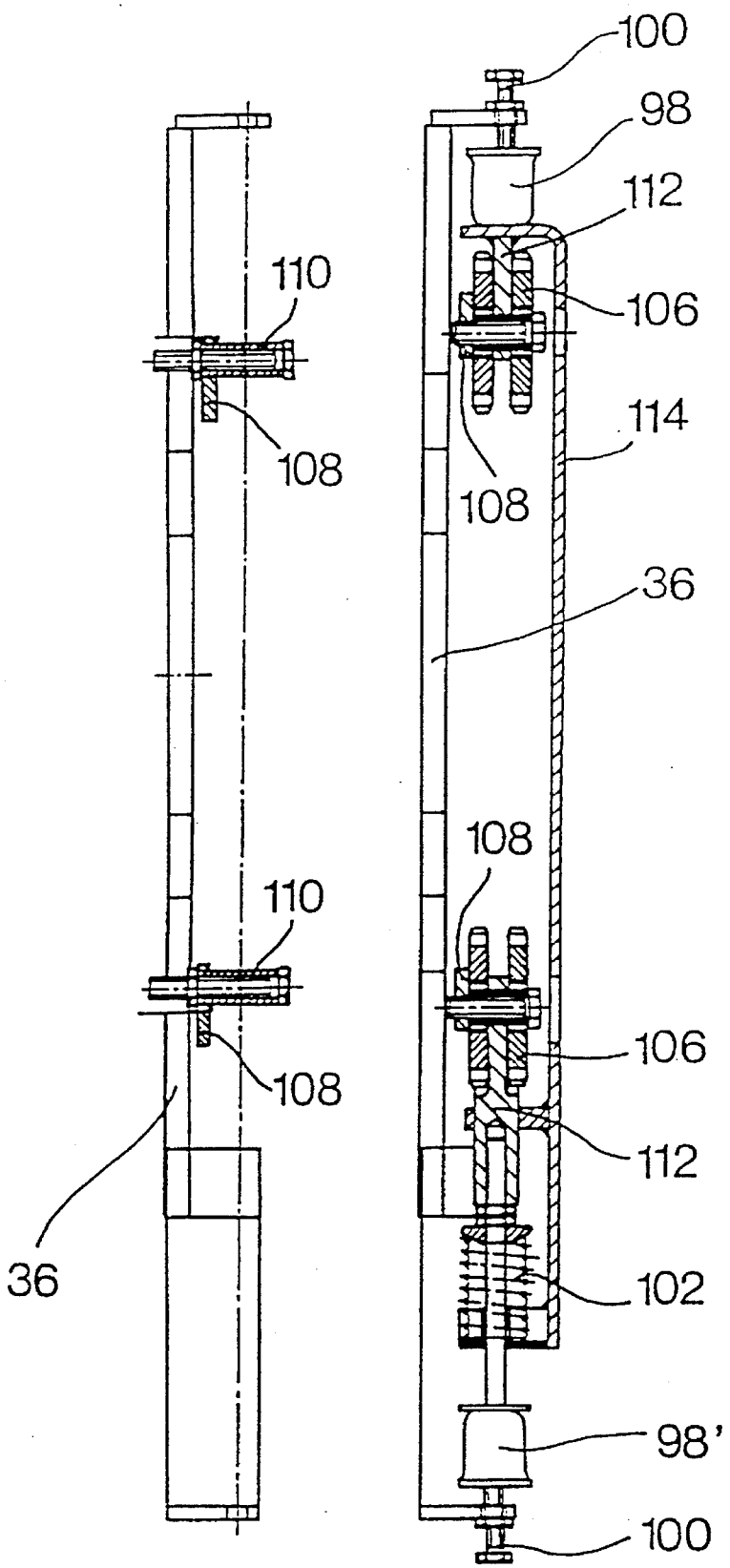
FIG. 8 is an enlarged side elevational view of a work-locating fixture or stretching device, arranged pivotally over a bar lever for the drive mechanism of FIG. 2.

Bar lever 104 has two levers 108. One end of each lever is pivotally mounted to a rotary bushing 110 in bas, plate 36. The other lever ends support contact wheels 106 Contact wheels 106 are mounted to rotate in support forks 112. The bottom support fork 112 is seen in FIG. 8 and is supported on spring 102, which in turn is supported on a curved plate profile 114. The curved plate profile, to the side, encompasses both contact wheels 106 facing each other. Over the prebiasing of the elastically flexible spring 102, the spring and curved plate profile determine the distance of contact wheels 106 from one another.

As a result of the bearing according to the invention some exception can also be granted to the elastic front walls 28. The front walls, like walls 30 arranged at the unloading end, can also be of an inflexible material. The wobbling movements of the individual drums 10, occurring under some conditions and now increased, can still be absorbed by the bearings according to the present invention.

Swivel 32, as illustrated is essentially formed of a flat plate having rounded ends. The curve radius of the rounded ends corresponds to the curve radius of rollers 34. These flat swivel plates can also have a break in the curve instead of at the point of the swivel axis, so that the swivel axis of the swivel is arranged in planes offset to the rotary axes of rollers 34.

While various embodiments have been chosen to illustrate the invention, it will be understood by those skilled in the art that various changes and modifications can be made therein without departing from the scope of the invention as defined in the appended claims.

What is claimed is:

1. A washing machine, comprising:

at least one drum mounted for rotation about a spindle axis;

bearings supporting said drum to absorb axial and radial forces generated by movement of said drum, each of said bearings including a swivel pivotally mounted about a swivel axis and at least one first roller rotatably mounted on said swivel; and tipping means, on each said bearing, for pivoting said bearing about a tipping axis transverse to said swivel axis.

2. A washing machine according to claim 1 wherein each said tipping means comprises a journal extending through a sheathing mounted in a central portion of said swivel, each said journal having a free end portion having a transverse diameter smaller than a corresponding transverse diameter of said sheathing.

3. A washing machine according to claim 2 wherein each said journal comprises slanted contact surfaces along which said swivel pivots about said tipping axis.

4. A washing machine according to claim 3 wherein said contact surfaces are substantially spherical.

5. A washing machine according to claim 1 wherein a second roller is mounted on a central portion of each said swivel for rotation about a rotation axis transverse to a rotation axis of said first roller, each said second roller contacting a roller surface of a front end of said drum.

6. A washing machine according to claim 1 wherein a plurality of drums are coaxially arranged for rotation about said spindle axis; and at least one of said bearings is located between each of said drums.

7. A washing machine according to claim 6 wherein each of said bearing is connected to a central frame at least partially encompassing said drums;

said central frame comprises two longitudinal struts on opposite sides of said drums; and said bearings between said drums are articulated as part of balancing means mounted on said frame.

8. A washing machine according to claim 7 wherein said drums comprise a loading end and an unloading end; and said bearings located at said loading end and said unloading end are connected to said longitudinal struts.

9. A washing machine according to claim 8 wherein each of said bearings are connected to said central frame by elastic connecting means.

10. A washing machine according to claim 1 wherein said drum comprises toothed crowns on a loading end and an unloading end of said drum;

said first rollers of said bearings at said loading end and said unloading end roll on said toothed crowns; and drive means, engaging said toothed crowns, rotates said drum.

11. A washing machine according to claim 10 wherein said drive means comprises two drive axes parallel to and spaced laterally from said spindle axis, said drive axes and said spindle axis extending in a horizontal plane.

12. A washing machine according to claim 11 wherein said drive means comprises first and second drive belts engaging said toothed crowns between said drive axes.

13. A washing machine according to claim 12 wherein stretching means engage and stabilize said drive belts, said stretching means including accumulators holding contact wheels rotatably mounted on rod levers in engagement with said drive belts.

14. A washing machine, comprising:

at least one drum mounted for rotation about a spindle axis;

bearings supporting said drum to absorb axial and radial forces generated by movement of said drum, each of said bearings including a swivel pivotally mounted about a swivel axis and at least one first roller rotatably mounted on said swivel; and a second roller mounted on each said swivel for rotation about rotation axis transverse to a rotation axis of said first roller.

15. A washing machine according to claim 14 wherein said second roller is mounted in a central portion of each said swivel, each said second roller contacting a rolling surface on a front end of said drum.

* * * * *